US009782658B2

(12) United States Patent
Kim

(10) Patent No.: US 9,782,658 B2
(45) Date of Patent: Oct. 10, 2017

(54) BALL PITCHING DEVICE

(71) Applicant: CLOUDGATE CORP., Seoul (KR)

(72) Inventor: Seongjun Kim, Seoul (KR)

(73) Assignee: CLOUDGATE CORP. (KR)

( * ) Notice: Subject to any disclaimer, the term of this patent is extended or adjusted under 35 U.S.C. 154(b) by 0 days.

(21) Appl. No.: 15/394,795

(22) Filed: Dec. 29, 2016

(65) Prior Publication Data

US 2017/0182394 A1 Jun. 29, 2017

(30) Foreign Application Priority Data

Dec. 29, 2015 (KR) ..... 10-2015-0188466
Dec. 30, 2015 (KR) ..... 10-2015-0189137

(51) Int. Cl.
*F41B 4/00* (2006.01)
*A63B 69/40* (2006.01)
*A63B 69/00* (2006.01)

(52) U.S. Cl.
CPC ..... *A63B 69/406* (2013.01); *A63B 69/0002* (2013.01); *A63B 69/409* (2013.01); *A63B 2069/0008* (2013.01); *A63B 2069/404* (2013.01)

(58) Field of Classification Search
CPC ..... A63B 69/406
See application file for complete search history.

(56) References Cited

U.S. PATENT DOCUMENTS 4,325,351 A * 4/1982 Yuasa ..... A63B 69/406 124/53.5
4,442,823 A * 4/1984 Floyd ..... A63B 69/406 124/41.1
4,712,534 A * 12/1987 Nozato ..... A63B 69/406 124/3
5,125,653 A * 6/1992 Kovacs ..... A63B 69/406 124/78
5,464,208 A * 11/1995 Pierce ..... A63B 69/406 124/78
6,443,140 B1 9/2002 Crews et al.
7,040,309 B2 * 5/2006 Johndreau ..... A63B 69/406 124/78

FOREIGN PATENT DOCUMENTS

JP 2786616 B2 5/1998
JP 2000245887 A 9/2000
JP 2005224356 A 8/2005

(Continued)

*Primary Examiner* — John Ricci
(74) *Attorney, Agent, or Firm* — Renaissance IP Law Group LLP

(57) ABSTRACT

A ball pitching device includes: a body portion including an upper frame and a lower frame; a first rotation shaft portion supported by the upper frame; a pitching unit configured to pitch a ball and rotate about the first rotation shaft portion and including a first pitching wheel and a second pitching wheel; a first pitching angle adjusting unit adjusting a vertical pitching angle by adjusting a relative length between a bottom surface of the upper frame and the pitching unit; and a second rotation shaft portion connecting the upper frame to the lower frame to be rotatable on a horizontal plane. The first rotation shaft portion is disposed between a center of the first pitching wheel and a center of the second pitching wheel.

15 Claims, 11 Drawing Sheets

(56) References Cited

FOREIGN PATENT DOCUMENTS

| | | | |
|---|---|---|---|
| KR | 20020018185 | A | 3/2002 |
| KR | 100552601 | B1 | 2/2006 |
| KR | 101209384 | B1 | 12/2012 |
| KR | 101239527 | B1 | 3/2013 |
| KR | 101382188 | B1 | 4/2014 |

* cited by examiner

BALL PITCHING DEVICE

CROSS-REFERENCE TO RELATED APPLICATION

This application claims priority under 35 U.S.C. §119 to Korean Patent Applications No. 10-2015-0188466, filed on Dec. 29, 2015, and No. 10-2015-0189137, filed on Dec. 30, 2015, in the Korean Intellectual Property Office (KIPO), the disclosures of which are incorporated by reference herein in their entirety.

BACKGROUND

1. Field

Embodiments of the invention relate to a ball pitching device, and more particularly, to a ball pitching device having a structure capable of rotating a pitching unit about a ball pitching direction.

2. Description of the Related Art

A pitching device is a machine that pitches a ball to a batter for baseball batting practices. The pitching devices help batting practices not only for baseball players, but also for the general public who enjoy baseball as a hobby.

Conventional pitching devices are mainly designed to supply balls in a desired direction at a desired speed. In such a case, balls of various pitches that an actual pitcher throws may not be thrown.

In a real baseball game, pitches of the balls are classified into a fastball and a breaking ball. In addition, the fastball and the breaking ball are further subdivided into a variety of types such as a two-seam fastball, a rising fastball, a four-seam fastball, a curve, a slider, a sinker, and a changeup.

In varying the pitches of the balls in various ways, the direction and angle of ball pitching are important. That is, it is necessary to adjust the pitching direction and angle of the pitching device.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the invention are directed to a ball pitching device capable of implementing balls of various pitches in ball pitching.

According to one embodiment of the invention, a ball pitching device includes: a body portion including an upper frame and a lower frame; a first rotation shaft portion supported by the upper frame; a pitching unit configured to pitch a ball and rotate about the first rotation shaft portion and including a first pitching wheel and a second pitching wheel; a first pitching angle adjusting unit adjusting a vertical pitching angle by adjusting a relative length between a bottom surface of the upper frame and the pitching unit; and a second rotation shaft portion connecting the upper frame to the lower frame to be rotatable on a horizontal plane. The first rotation shaft portion is disposed between a center of the first pitching wheel and a center of the second pitching wheel.

The first pitching angle adjusting unit may include: a first adjusting portion; a length adjusting portion connected to the first adjusting portion; and a housing covering the length adjusting portion.

The length adjusting portion may include: a rotation spindle connected to the first adjusting portion and having threads; and a nut portion fixed to the housing. The rotation spindle may be inserted to the nut portion.

Each of the rotation spindle and the nut portion may include: a coupling portion spaced apart from the first adjusting portion and having threads; and a non-coupling portion at opposite end portions of the coupling portion.

An outer diameter of the non-coupling portion of the rotation spindle may be less than an inner diameter of the coupling portion of the nut portion.

An outer diameter of the coupling portion of the rotation spindle may be less than an inner diameter of the non-coupling portion of the nut portion.

The ball pitching device may further include a second pitching angle adjusting unit at the body portion, the second pitching angle adjusting unit adjusting a left and right pitching angle of the pitching unit by rotating the upper frame about the second rotation shaft portion.

The second pitching angle adjusting unit may include: a main driving gear connected to one of the upper frame and the lower frame; and a driven gear connected to the other of the upper frame and the lower frame and engaged with the main driving gear.

One end portion of the first pitching angle adjusting unit may be connected to the body portion by a hinge.

Another end portion of the first pitching angle adjusting unit may be connected by a hinge to a ball insert tube configured to insert a ball into the pitching unit.

The ball pitching device may further include: a ball insert tube configured to insert a ball into the pitching unit; and a ball discharge tube through which the ball is discharged from the pitching unit. The pitching unit may be rotatably coupled to at least one of the ball insert tube and the ball discharge tube and rotates about substantially a same rotation axis as a central axis of the ball discharge tube.

The pitching unit may include: a fixing unit connected to the ball insert tube and the ball discharge tube; a pair of wheel motors on the fixing unit; and a pair of pitching wheels connected to the wheel motors, respectively.

The fixing unit may include: a first fixing portion substantially parallel to the central axis; and a second fixing portion connected to the first fixing portion and supporting the pair of wheel motors. The first fixing portion may include a coupling portion rotatably coupled to the ball insert tube and the ball discharge tube.

The ball pitching device may further include a driving unit rotating the pitching unit. The driving unit may include: a driving motor on the fixing unit, the driving motor providing a rotational force; a main driving gear connected to the driving motor; and a guide gear on an outer circumferential surface of at least one of the ball insert tube and the ball discharge tube, the guide gear engaged with the main driving gear.

The ball pitching device may further include a driving unit rotating the pitching unit. The driving unit may include: a driving motor on the fixing unit, the driving motor providing a rotational force; a main driving sprocket connected to the driving motor; a chain engaged with the main driving sprocket; and a guide sprocket disposed along an outer circumferential surface of the ball discharge tube and engaged with the main driving sprocket by the chain.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present disclosure of invention will be more clearly understood from the following detailed description taken in conjunction with the accompanying drawings, in which.

DETAILED DESCRIPTION

Figure 1:
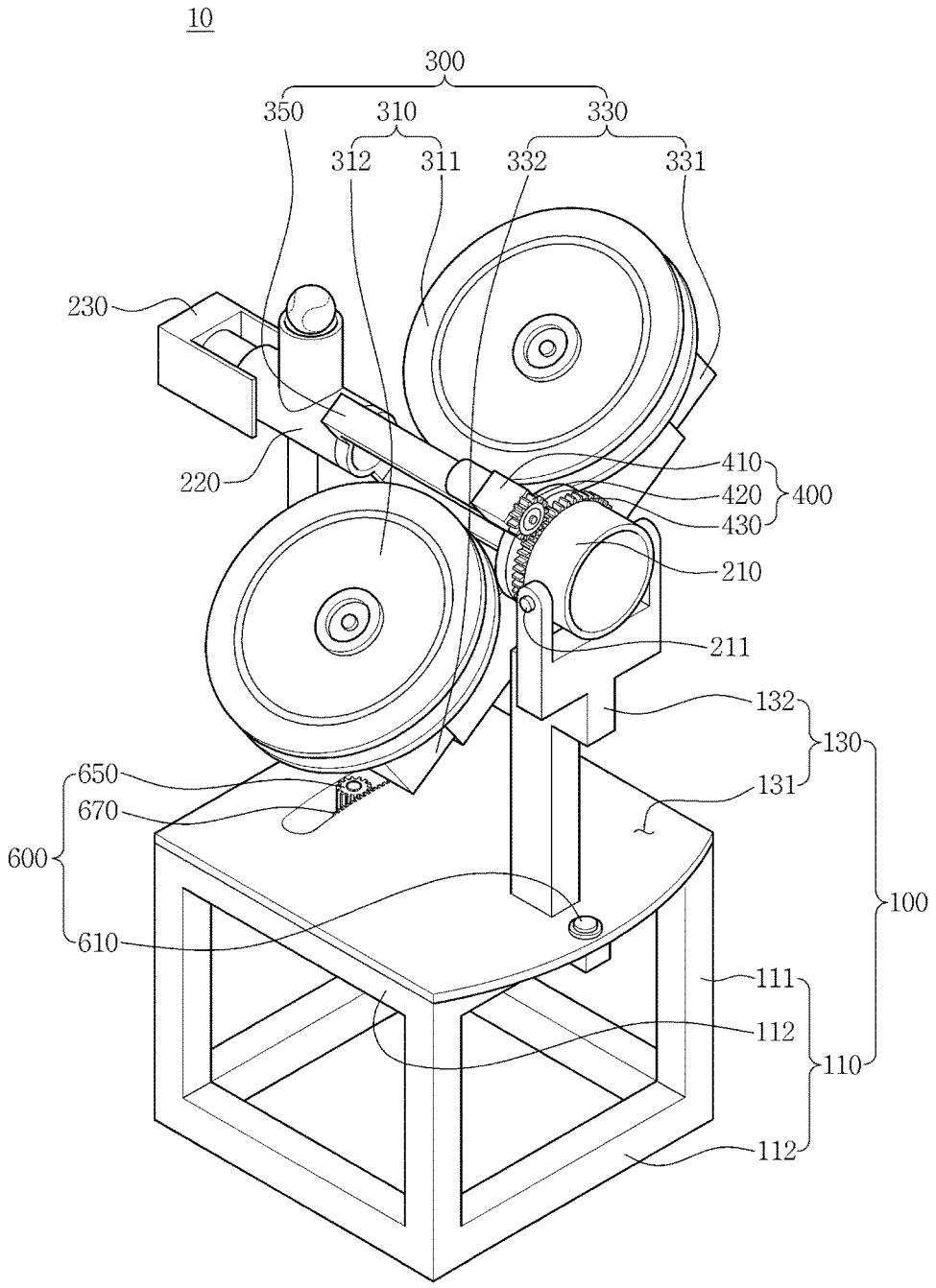
FIG. 1 is a perspective view illustrating a ball pitching device according to one embodiment of the present invention.

Advantages and features of the invention and methods for achieving them will be made clear from embodiments described below in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. The invention is merely defined by the scope of the claims. Therefore, well-known constituent elements, operations and techniques are not described in detail in the embodiments in order to prevent the invention from being obscurely interpreted. Like reference numerals refer to like elements throughout the specification.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "less", "above", "upper", and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Some of the parts which are not associated with the description may not be provided in order to specifically describe embodiments of the present invention, and like reference numerals refer to like elements throughout the specification.

Hereinafter, a ball pitching device 10 according to one embodiment of the present invention will be described with reference to the drawings.

Figure 2:
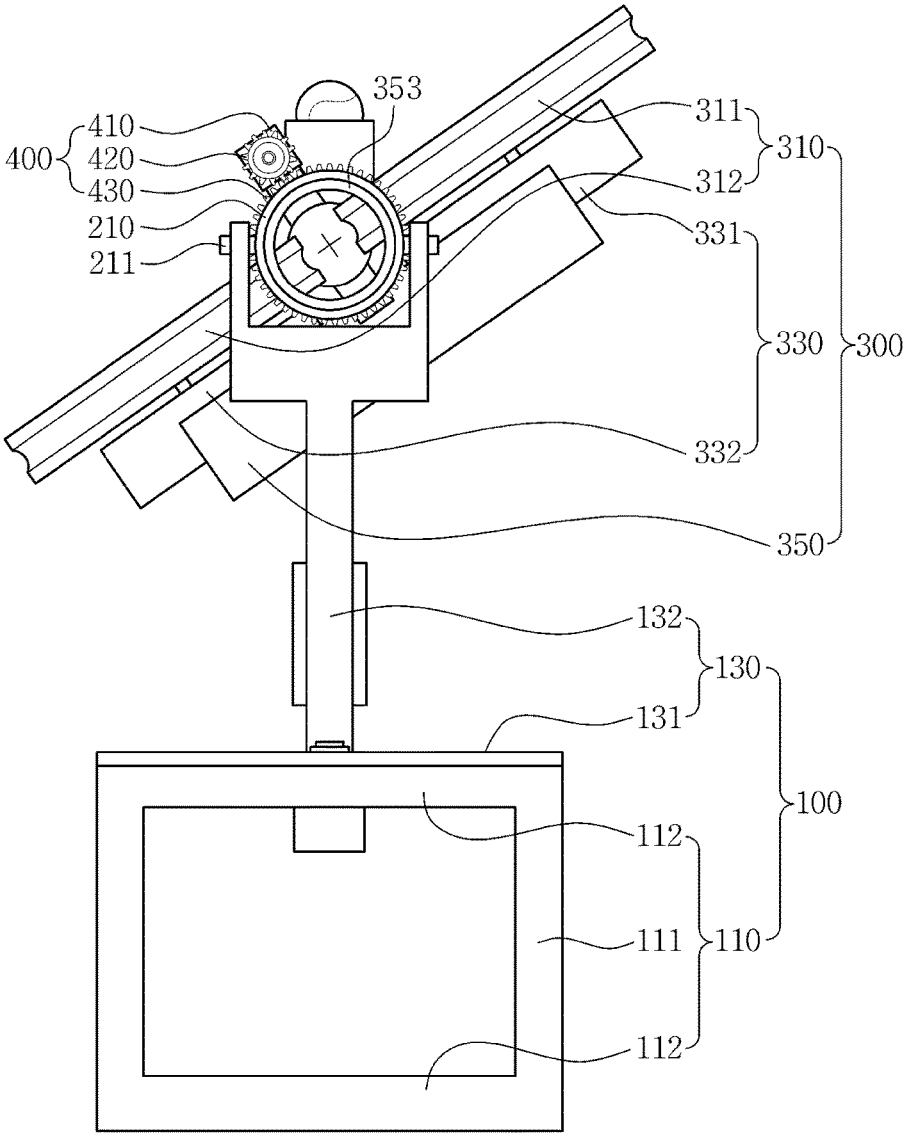
FIG. 2 is a front view illustrating the ball pitching device illustrated in FIG. 1.

FIG. 1 is a perspective view illustrating the ball pitching device 10 according to one embodiment of the present invention, and FIG. 2 is a front view illustrating the ball pitching device 10 illustrated in FIG. 1.

Referring to FIGS. 1 and 2, the ball pitching device 10 includes a body portion 100, a ball discharge tube 210 and a ball insert tube 220 on the body portion 100, a pitching unit 300 rotatably disposed among the ball discharge tube 210 and the ball insert tube 220, and a driving unit 400 connected to the pitching unit 300.

In addition, the ball pitching device 10 may further include a first pitching angle adjusting unit 500 and a second pitching angle adjusting unit 600.

Referring to FIGS. 1 and 2, the body portion 100 includes a lower frame 110 and an upper frame 130.

The lower frame 110 may include a vertical frame 111 and a horizontal frame 112. In such an embodiment, the horizontal frame 112 is disposed substantially parallel to a horizontal plane, and the vertical frame 111 is disposed substantially perpendicular to the horizontal frame 112.

The vertical frame 111 may include a plurality of vertical frames 111 and the horizontal frame 112 may include a plurality of horizontal frames 112. The plurality of vertical frames 111 and the plurality of horizontal frames 112 may have different lengths. In addition, the vertical frame 111 and the horizontal frame 112 may have a bar shape, a stick shape, or a plate shape.

The vertical frame 111 and the horizontal frame 112 may include or be formed of a material known in the art. That is, the vertical frame 111 and the horizontal frame 112 may include aluminum (AI), steel use stainless (SUS), or a carbon fiber compound (carbon fiber reinforced plastic), for example. In such an embodiment, the body portion 100 may achieve both a high degree of lightweight and excellent rigidity. However, embodiments are not limited thereto, and the vertical frame 111 and the horizontal frame 112 may include any suitable material.

In addition, a hole corresponding to a guide groove 153 to be described below may be defined in the lower frame 110.

The upper frame 130 may include a bottom portion 131 and a support frame 132.

The bottom portion 131 is disposed on the lower frame 110. The bottom portion 131 may have a surface shape, and is disposed to face the lower frame 110. The guide groove 153, to be described below, may be defined in the bottom portion 131.

In one embodiment, a friction reducing member (not illustrated) may be further disposed between the bottom portion 131 and the lower frame 110. In such an embodiment, the friction reducing member may be a plane bearing disposed between the bottom portion 131 and the lower frame 110. Alternatively, the plane bearing may be a ball bearing, a needle bearing, or a cylindrical bearing.

The support frame 132 is disposed on the bottom portion 131 and may include a plurality of rods or bars. In one embodiment, the support frame 132 may include a U shape bar and a rod connected to the U shape bar in order to support the ball discharge tube 210. In addition, the plurality of rods and bars may be integrally formed.

Figure 3:
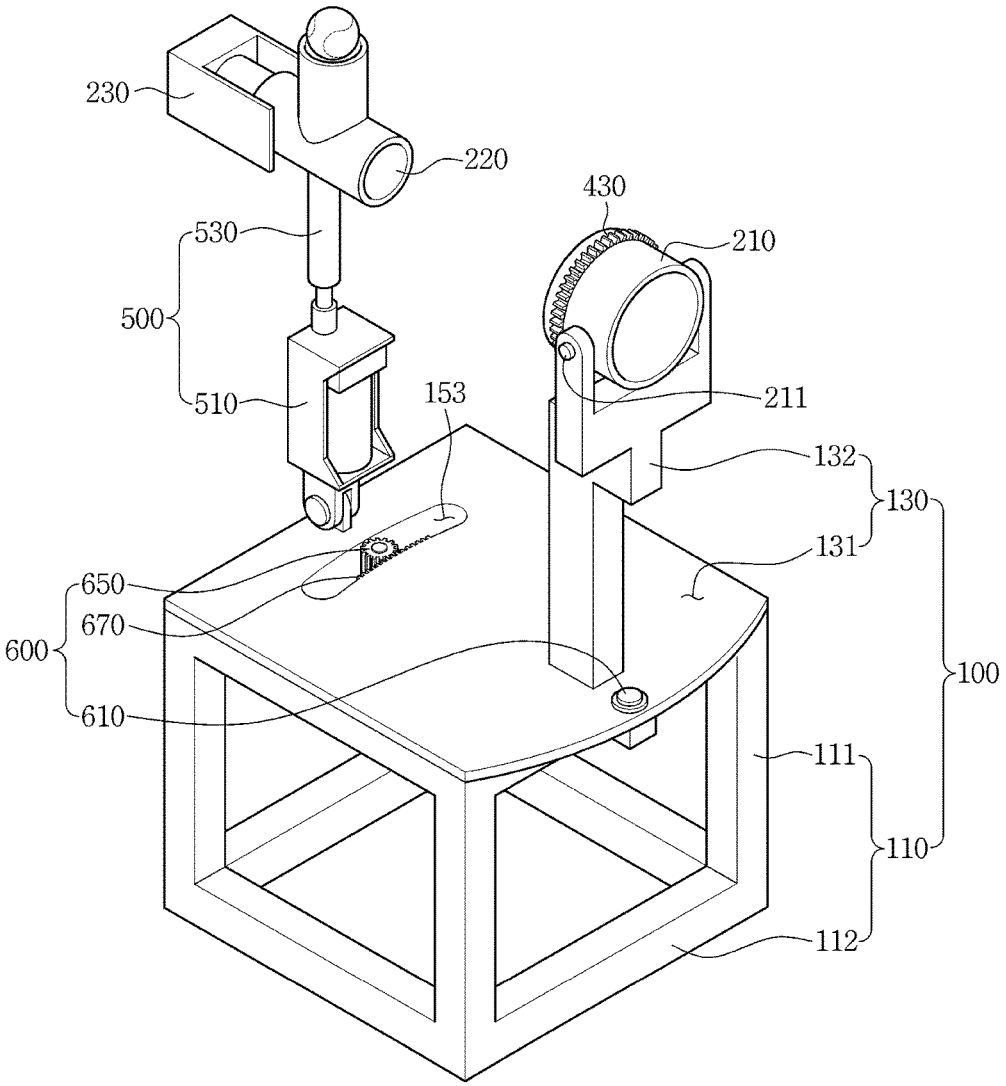
FIG. 3 is a perspective view illustrating the ball pitching device excluding a pitching unit.

FIG. 3 is a perspective view illustrating the ball pitching device 10 excluding the pitching unit 300.

Referring to FIG. 3, the ball discharge tube 210 is an output portion which is disposed above the body portion 100 to discharge a ball that is accelerated by the pitching unit 300.

The ball discharge tube 210 according to one embodiment of the present invention has a cylindrical shape, and a first rotation shaft portion 211 is connected to opposite end portions of the ball discharge tube 210. Opposite end portions of the first rotation shaft portion 211 may be fixed by the support frame 132. The ball discharge tube 210 may be rotatably connected to the support frame 132 to be rotatable in a vertical direction about the first rotation shaft portion 211. In addition, the first rotation shaft portion 211 is inserted to the support frame 132 and a bearing may be disposed between the first rotation shaft portion 211 and the support frame 132.

In an alternative embodiment, the first rotation shaft portion 211 may be integrally formed with the ball discharge tube 210 and inserted to the support frame 132.

The ball insert tube 220, disposed on the body portion 100, serves as a passage for supplying a ball to the pitching unit 300 to be described below. The ball insert tube 220 according to one embodiment is supported by the first pitching angle adjusting unit 500 to be described below. The ball insert tube 220 is cylindrical in shape and has an opening at a front end thereof connected to the pitching unit 300, an opening at a rear end thereof connected to an actuator 230 to be described below, and an opening at a top end thereof to which the ball is inserted. However, embodiments are not limited thereto, and the passage into which the balls are inserted may have any suitable shape.

Referring to FIG. 3, the actuator 230 according to one embodiment of the present invention is disposed at a rear surface of the ball pitching device 10 and connected to the ball insert tube 220. The actuator 230 pushes the ball passing through the ball insert tube 220 to the pitching unit 300.

The actuator 230 is inserted to the opening at the rear end of the ball insert tube 220, and moves forward and backward to transfer the ball. The actuator 230 may be any necessary driving source such as a hydraulic cylinder, a pneumatic cylinder, a linear motor, an internal combustion engine, an external combustion engine, and a solenoid device.

In addition, the actuator 230 may further include a bracket (not illustrated). The bracket is coupled inside the ball insert tube 220 in an insertion manner to contact the inserted ball. In order to prevent the ball from spinning during the forward movement, a contact surface of the bracket contacting the ball may have a curved surface corresponding to the diameter of the ball.

Referring to FIGS. 1 and 2, the pitching unit 300 is disposed between the ball discharge tube 210 and the ball insert tube 220 and is rotatably coupled to at least one of the ball insert tube 220 and the ball discharge tube 210 to discharge the ball inserted from the ball insert tube 220 to the ball discharge tube 210.

The pitching unit 300 has substantially a same rotation axis as a central axis of the ball discharge tube 210.

The pitching unit 300 includes a fixing unit 350, a pair of wheel motors 330 at the fixing unit 350, and a pair of pitching wheels 310 connected to the pair of wheel motors 330.

Figure 4:
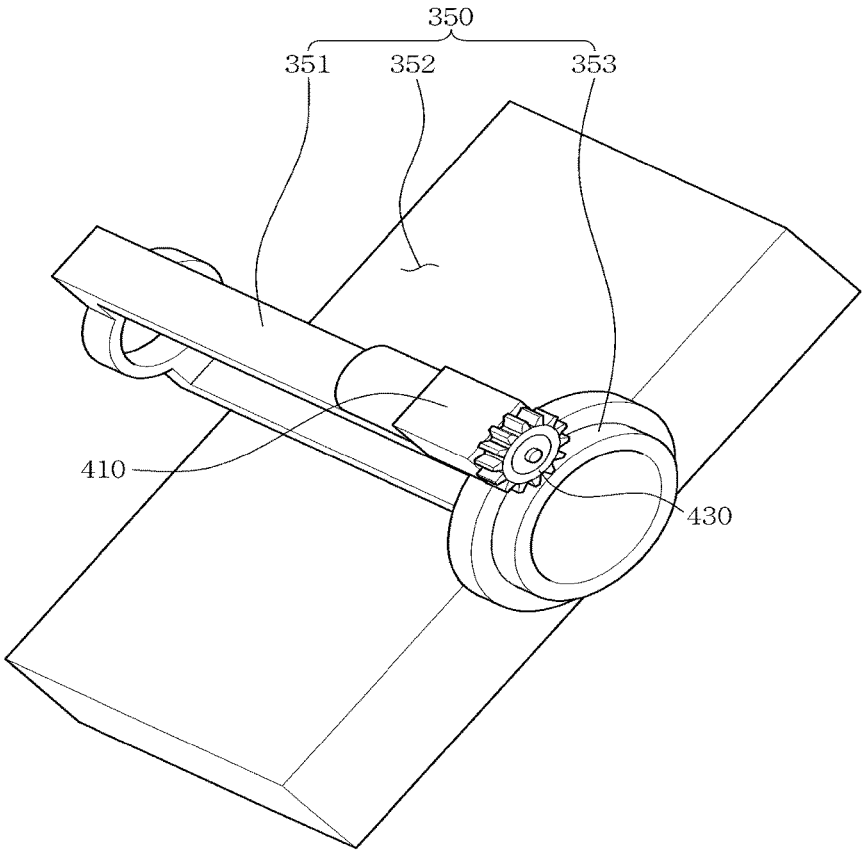
FIG. 4 is a view illustrating a fixing unit illustrated in FIG. 1.

FIG. 4 is a view illustrating the fixing unit 350 illustrated in FIG. 1.

Referring to FIG. 4, the fixing unit 350 includes a first fixing portion 351 and a second fixing portion 352.

The first fixing portion 351 is disposed between the ball discharge tube 210 and the ball insert tube 220 and may be substantially parallel to the central axis of the ball discharge tube 210. The first fixing portion 351 includes a plurality of rods or bars.

In addition, the first fixing portion 351 according to one embodiment of the present invention is provided as a pair of frames spaced apart from each other. In such an embodiment, the pitched ball passes through a space defined by the pair of frames spaced apart from each other.

The first fixing portion 351 includes coupling portions 353 disposed at opposite ends thereof.

The coupling portions 353 are rotatably coupled to the ball discharge tube 210 and the ball insert tube 220, respectively, and may be inserted inside one of the ball insert tube 220 and the ball discharge tube 210 that is coupled to a guide gear 430.

In one embodiment, in the case where the guide gear 430 is disposed on an outer circumferential surface of the ball discharge tube 210, the coupling portion 353 on the side of the ball discharge tube 210 is inserted inside the ball discharge tube 210 to be coupled thereto. In addition, the coupling portion 353 on the side of the ball insert tube 220 may be inserted into the ball insert tube 220, if necessary.

In such an embodiment, accordingly, an outer diameter of the coupling portion 353 on the side of the ball discharge tube 210 is less than an inner diameter of the ball discharge tube 210. The coupling portion 353 is coupled to a bearing to be inserted into the ball discharge tube 210.

The bearing is disposed between the coupling portion 353 and the ball discharge tube 210 and between the coupling portion 353 and the ball insert tube 220. An example of the bearing may include a ball bearing, but embodiments are not limited thereto. The bearing may include a slide bearing. An inner ring (not illustrated) of the bearing may be fixedly coupled to the coupling portion 353, and an outer side thereof may be rotatably coupled to the ball discharge tube 210 and the ball insert tube 220 to be rotated unrestrictedly.

In an alternative embodiment, when the guide gear 430 is disposed on an outer circumferential surface of the ball insert tube 220, the coupling portion 353 on the side of the ball insert tube 220 is inserted inside the ball insert tube 220 to be coupled thereto. In addition, the coupling portion 353 on the side of the ball discharge tube 210 may be inserted into the ball discharge tube 210, if necessary.

In such an embodiment, an outer diameter of the coupling portion 353 is less than an inner diameter of the ball insert tube 220. The coupling portion 353 is coupled to the bearing to be inserted to the ball insert tube 220.

The second fixing portion 352 is connected to the first fixing portion 351 and supports the pair of wheel motors 330 to be described below. The second fixing portion 352 may include a plurality of rods, a bar, or a surface.

In such an embodiment, the first fixing portion 351 and the second fixing portion 352 may be integrally formed.

Referring back to FIG. 1, the pair of wheel motors 330 are disposed on the second fixing portion 352 of the fixing unit 350. The pair of wheel motors 330 include a first wheel motor 331 and a second wheel motor 332. The first wheel motor 331 is disposed on the left side of the second fixing portion 352 and the second wheel motor 332 is disposed on the right side of the second fixing portion 352. That is, the first wheel motor 331 and the second wheel motor 332 are arranged to face each other in the left-right direction.

In one embodiment, the wheel motor 330 may be a step motor including a stator and a rotor. The stator includes a pair of coils disposed to face each other to form a plurality of pole pairs. In addition, the pair of coils include a plurality of pairs of coils.

Accordingly, in the case where a current flows in one pair of coils of the plurality of pairs of coils, the rotor rotates toward another pair of coils. That is, when the polarity of the coil changes continuously and alternately, the rotor rotates a predetermined angle in response to the change of the coil polarity.

In one embodiment, the pair of wheel motors 330 may be protected by a motor case.

The pair of pitching wheels 310 are connected to the pair of wheel motors 330. The pair of pitching wheels 310 according to one embodiment of the present invention include a first pitching wheel 311 and a second pitching wheel 312. The first pitching wheel 311 is connected to a shaft of the first wheel motor 331 to face the first wheel motor 331, and the second pitching wheel 312 is connected to a shaft of the second wheel motor 332 to face the second wheel motor 332. Accordingly, the first pitching wheel 311 rotates by a driving force of the first wheel motor 331. Similarly, the second pitching wheel 312 rotates by a driving force of the second wheel motor 332.

In such an embodiment, the first pitching wheel 311 and the second pitching wheel 312 are symmetrically spaced apart from each other with respect to the fixing unit 350 at a distance to pitch a ball. When inserted, the ball is engaged with an outer circumferential surface of the pitching wheel 310, and a distance between the ball and the outer circumferential surface of the pitching wheel 310 is determined so that the ball may be pitched with a predetermined pitch and at a predetermined speed due to rotational force of the ball and the pitching wheel 310.

In one embodiment, each of the first pitching wheel 311 and the second pitching wheel 312 may be rotated clockwise or counterclockwise. However, the rotational directions of the first pitching wheel 311 and the second pitching wheel 312 are different from each other. For example, the first pitching wheel 311 may be rotated clockwise and the second pitching wheel 312 may be rotated counterclockwise. In addition, the first pitching wheel 311 and the second pitching wheel 312 may be rotated at substantially a same speed or at different speeds.

Accordingly, the pitch of the ball may be variously changed according to the rotational directions and rotational speeds of the first pitching wheel 311 and the second pitching wheel 312.

In addition, a friction member may be disposed on the outer circumferential surface of the pitching wheel 310. For example, a friction member including a urethane material may be disposed on the outer circumferential surface of the pitching wheel 310 to adjust a frictional force with the ball being pitched.

Referring to FIG. 1, the driving unit 400 according to one embodiment of the present invention includes a driving motor 410, a main driving gear 420, and the guide gear 430.

The driving motor 410 according to one embodiment of the present invention is disposed on the fixing unit 350. For example, the driving motor 410 is disposed on an end portion of the fixing unit 350 on the side of the ball discharge tube 210. However, the position of the driving motor 410 is not limited thereto, and the driving motor 410 may be disposed at any suitable position to provide a rotational force to the fixing unit 350, e.g., the ball insert tube 220, the ball discharge tube 210, and the body portion 100.

In one embodiment, the driving motor 410 may be a step motor including a stator and a rotor. The stator includes a pair of coils disposed to face each other to form a plurality of pole pairs. In addition, the pair of coils include a plurality of pairs of coils. Accordingly, in the case where a current flows in one pair of coils of the plurality of pairs of coils, the rotor rotates toward another pair of coils. That is, when the polarity of the coil changes continuously and alternately, the rotor rotates a predetermined angle in response to the change of the coil polarity.

In addition, the driving motor 410 includes a motor having sufficient torque to allow the fixing unit 350 to rotate.

In one embodiment, the driving motor 410 may be protected by a motor case. The motor case is disposed around the driving motor 410 to block the noise generated by the driving unit 400.

The main driving gear 420 is connected to the driving motor 410. Accordingly, the main driving gear 420 receives the rotational force from the driving motor 410 to rotate.

The main driving gear 420 is engaged with the guide gear 430, to be described below, to rotate. Since rotating along the guide gear 430, the main driving gear 420 revolves about a central point of the guide gear 430. In such an embodiment, as the main driving gear 420 is fixed to the fixing unit 350, the fixing unit 350 also rotates as the main driving gear 420 revolves.

The guide gear 430 is fixedly disposed along the outer circumferential surface of the ball discharge tube 210. Teeth of the guide gear 430 are engaged with teeth of the main driving gear 420. The guide gear 430 according to one embodiment of the present invention does not rotate but serves as a guide for revolving of the main driving gear 420. That is, the teeth of the guide gear 430 may correspond to a locus of the main driving gear 420.

In an alternative embodiment, the guide gear 430 may be disposed along the outer circumferential surface of the ball insert tube 220. In such an embodiment, the main driving gear 420 engaged with the guide gear 430 and the driving motor 410 connected to the main driving gear 420 are disposed at an end portion of the fixing unit 350 on the side of the ball insert tube 220.

In addition, the ball pitching device 10 according to one embodiment of the present invention may further include the first pitching angle adjusting unit 500.

Figure 5:
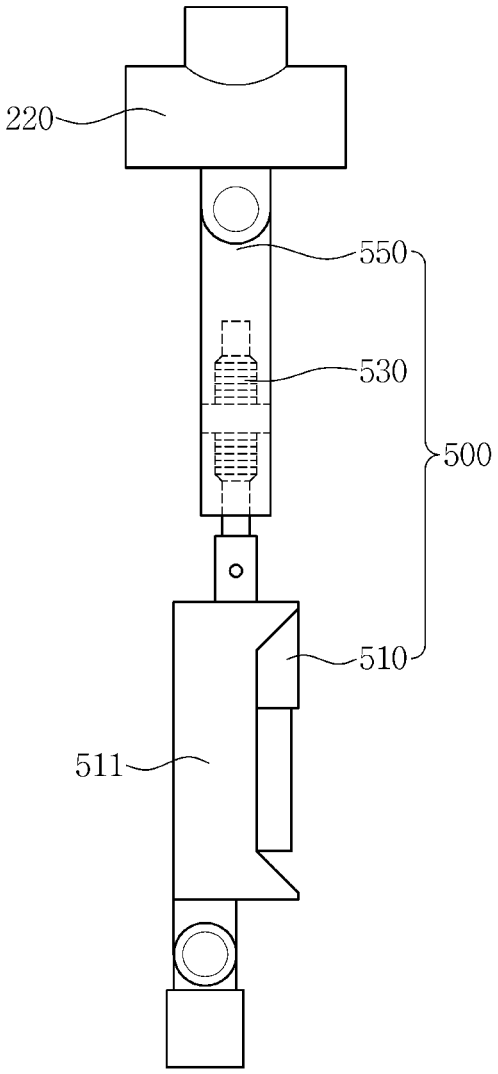
FIG. 5 is a view illustrating a first pitching angle adjusting unit of FIG. 1.

FIG. 5 is a view illustrating the first pitching angle adjusting unit 500 of FIG. 1.

Referring to FIGS. 1 and 5, one end portion of the first pitching angle adjusting unit 500 is connected to the bottom portion 131 by a hinge, and another end portion of the first pitching angle adjusting unit 500 is connected to the ball insert tube 220 by a hinge. The first pitching angle adjusting unit 500 adjusts a length of the first pitching angle adjusting unit 500 in rotation of the ball insert tube 220 and the pitching unit 300.

The first pitching angle adjusting unit 500 includes a first adjusting portion 510, a length adjusting portion 530 connected to the first adjusting portion 510, and a housing 550. In such an embodiment, the length adjusting portion 530 includes a rotation spindle connected to the first adjusting portion 510 and a nut portion into which the rotation spindle is inserted.

One side of the first adjusting portion 510 is connected to the bottom portion 131 by a hinge. The first adjusting portion 510 drives the length adjusting portion 530, whereby a length of the length adjusting portion 530 is changed. The first adjusting portion 510 may be a cylinder or a motor. A first adjusting portion case 511 may be further disposed around the first adjusting portion 510. The first adjusting portion case 511 covers the entirety of or a part of the first adjusting portion 510. For example, the first adjusting portion case 511 may be disposed to cover the front side and opposite lateral sides of the first adjusting portion 510. By disposed around the first adjusting portion 510, the first adjusting portion case 511 may block the noise generated in the first adjusting portion 510.

In one embodiment, the first adjusting portion 510 may be a step motor including a stator and a rotor. The stator includes a pair of coils disposed to face each other to form a plurality of pole pairs. In addition, the pair of coils include a plurality of pairs of coils. Accordingly, in the case where a current flows in one pair of coils of the plurality of pairs of coils, the rotor rotates toward another pair of coils. That is, when the polarity of the coil changes continuously and alternately, the rotor rotates a predetermined angle in response to the change of the coil polarity.

The pitching unit 300 causes vertical and horizontal displacements in the process of rotating with respect to the first rotation shaft portion 211. In such an embodiment, a force in the horizontal direction due to the displacement of the pitching unit 300 in the horizontal direction is applied to the first pitching angle adjusting unit 500. When the horizontal force is repeatedly applied to the first pitching angle adjusting unit 500, the first pitching angle adjusting unit 500 may be deformed or destroyed.

In consideration of this issue, opposite end portions of the first pitching angle adjusting unit 500 are connected by hinges. Accordingly, the first pitching angle adjusting unit 500 rotates with respect to the hinges at the opposite ends in accordance with the horizontal force generated due to the horizontal displacement of the pitching unit 300. That is, the first pitching angle adjusting unit 500 may not be deformed or destroyed due to the horizontal displacement of the pitching unit 300.

The length adjusting portion 530 is connected to the first adjusting portion 510 in an axial direction of the first pitching angle adjusting unit 500. The nut portion of the length adjusting portion 530 may have a cylindrical shape. Each of the rotation spindle and the nut portion of the length adjusting portion 530 has a coupling portion and a non-coupling portion. The coupling portion is a treaded area which is spaced apart from the first adjusting portion 510. The non-coupling portion is positioned at opposite end portions of the coupling portion. The non-coupling portion has no thread.

The coupling portion of the rotation spindle is engaged with the coupling portion of the nut portion to be described below. An outer diameter of the non-coupling portion of the rotation spindle may be less than an inner diameter of the coupling portion of the nut portion. An outer diameter of the coupling portion of the rotation spindle may be less than an inner diameter of the non-coupling portion of the nut portion. When a first driving portion continuously operates without stopping, the non-coupling portion of the rotation spindle becomes to be positioned in an inner circumferential surface of the nut portion. Since the outer diameter of the non-coupling portion of the rotation spindle is less than the inner diameter of the coupling portion of the nut portion, the rotation spindle may idle inside the nut portion. That is, although the first adjusting portion 510 continuously operates the length adjusting portion 530, a damage to the length adjusting portion 530 may be substantially prevented (refer to 10-2015-0188466 [0062] and [00631]).

In addition, the ball pitching device 10 according to one embodiment of the present invention may include the second pitching angle adjusting unit 600.

Figure 6:
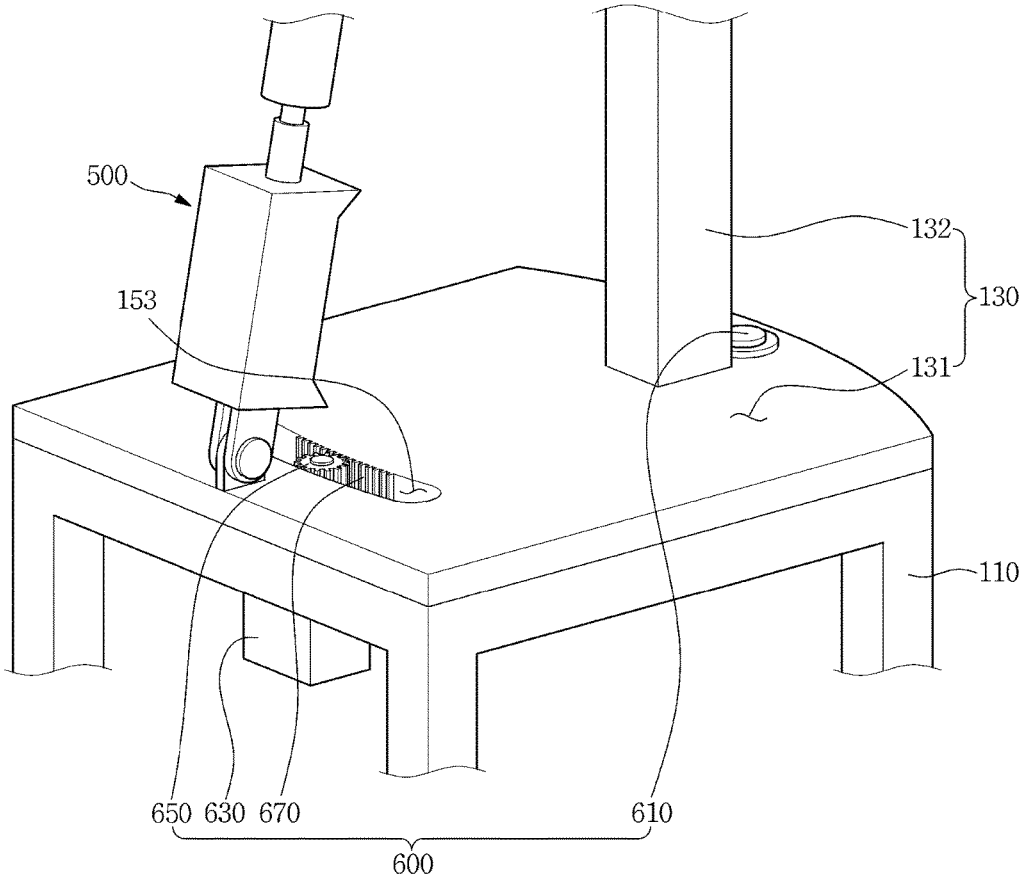
FIG. 6 is a view illustrating a second pitching angle adjusting unit of FIG. 1.

FIG. 6 is a view illustrating the second pitching angle adjusting unit 600 of FIG. 1.

Referring to FIG. 6, the second pitching angle adjusting unit 600 may include a second rotation shaft portion 610, a second adjusting portion 630, an adjusting gear 650, and a driven gear 670.

The second rotation shaft portion 610 is disposed substantially perpendicular to the support frame 132. The second rotation shaft portion 610 connects the upper frame 130 and the lower frame 110 so that the upper frame 130 disposed on the lower frame 110 may rotate on a horizontal plane. In one embodiment, the second rotation shaft portion 610 may have a cylindrical shape. In such an embodiment, one side of the second rotation shaft portion 610 may be inserted into the upper frame 130, and another side thereof may be inserted into the lower frame 110. Accordingly, the second rotation shaft portion 610 connects the upper frame 130 and the lower frame 110 by a hinge.

In an alternative embodiment, the second rotation shaft portion 610 may protrude from one of the upper frame 130 or the lower frame 110. In the case where the second rotation shaft portion 610 protrudes from the upper frame 130, the lower frame 110 is defined with a groove for insertion of the second rotation shaft portion 610. Alternatively, in the case where the second rotation shaft portion 610 protrudes from the lower frame 110, the upper frame 130 is defined with a groove for insertion of the second rotation shaft portion 610. That is, the second rotation shaft portion 610 may be modified into various embodiments in which the upper frame 130 may be rotatably connected to the lower frame 110.

The second adjusting portion 630 is disposed at the body portion 100, being spaced apart from the second rotation shaft portion 610. In such an embodiment, the second adjusting portion 630 may be a motor. For example, the second adjusting portion 630 may be a step motor. The step motor rotates a rotor by a predetermined angle according to the polarity of a current applied to a coil. In the case where the second adjusting portion 630 is the step motor, the inertial force generated when the upper frame 130 rotates is substantially minimized. Accordingly, the second pitching angle adjusting unit 600 may precisely and stably adjust a left and right pitching angle of the pitching unit 300. The adjusting gear 650 is connected to the second adjusting portion 630 in an axial direction and is rotated by a driving force of the second adjusting portion 630. The adjusting gear 650 is engaged with the driven gear 670 to be described below.

The guide groove 153 is defined in at least one of the bottom portion 131 of the upper frame 130 and the lower frame 110. The guide groove 153 may be arc-shaped around the second rotation shaft portion 610. The driven gear 670 is disposed on an inner circumferential surface of the guide groove 153. That is, gear teeth may be disposed along the inner circumferential surface of the guide groove 153. Accordingly, the adjusting gear 650 may be inserted into the guide groove 153 to be engaged with the driven gear 670. In an alternative embodiment, the guide groove 153 may be a guide hole defined in the bottom portion 131 or the lower frame 110. That is, the guide groove 153 may be a guide hole passing through the bottom portion 131 or the lower frame 110.

Figure 7:
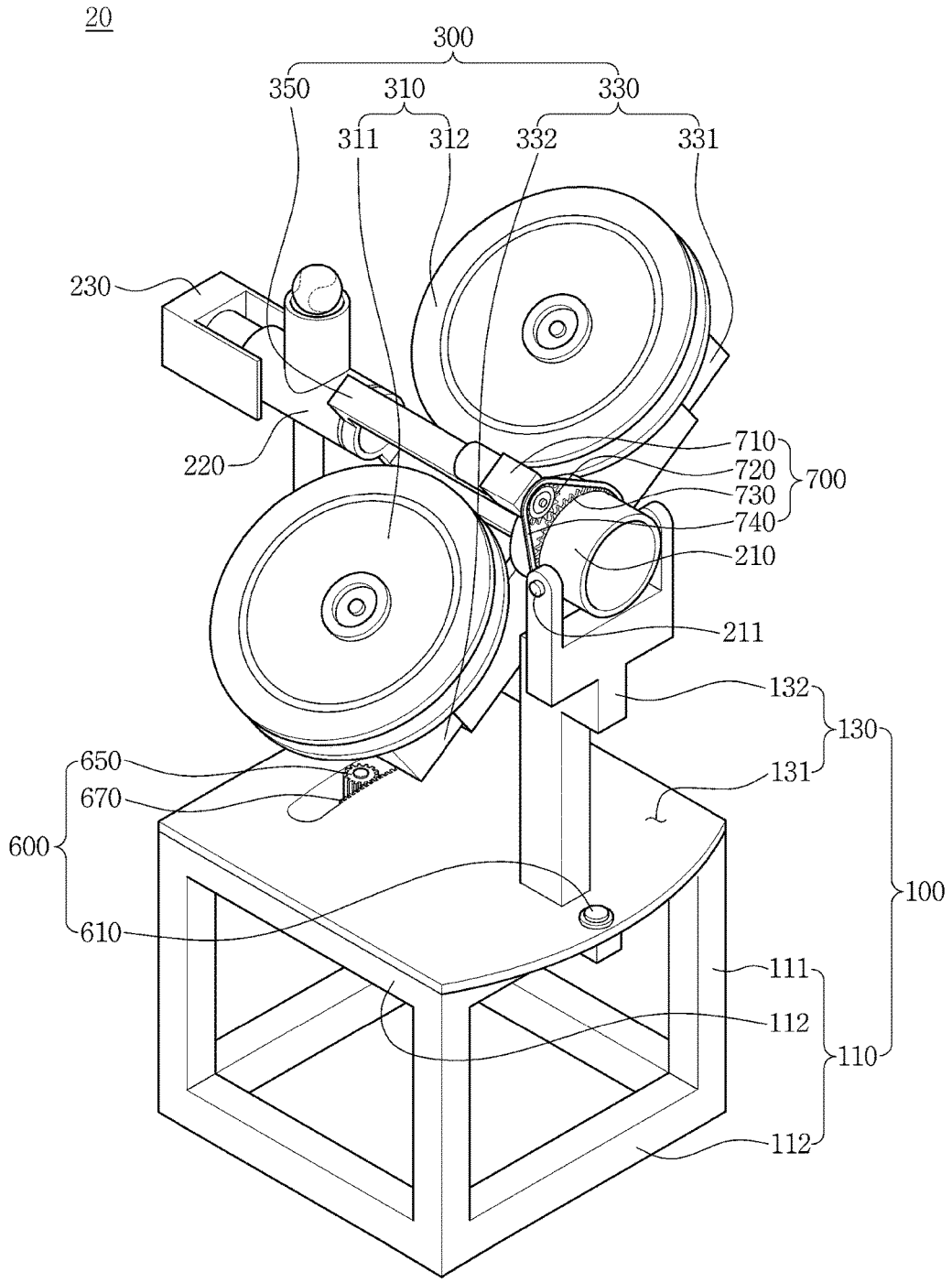
FIG. 7 is a perspective view illustrating a ball pitching device according to an alternative embodiment of the present invention.
Figure 8:
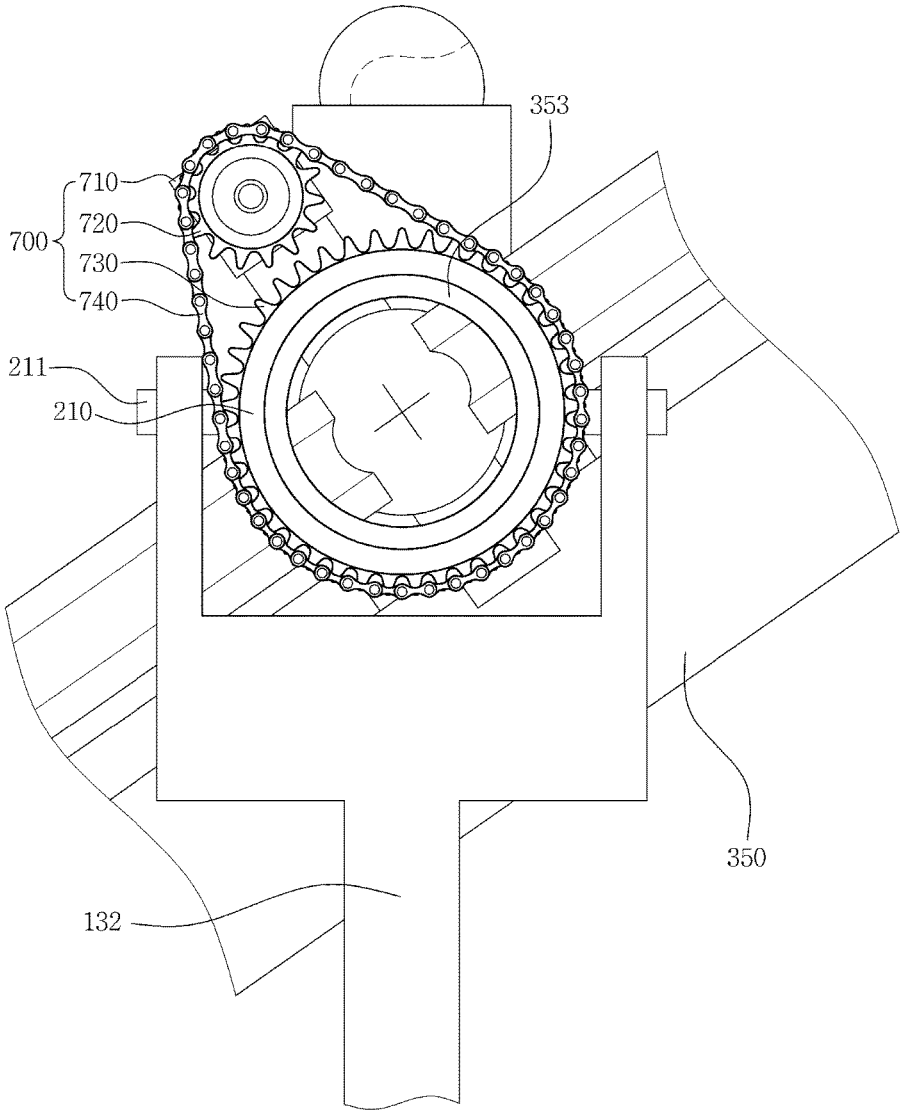
FIG. 8 is a front view illustrating the ball pitching device illustrated in FIG. 7.

FIG. 7 is a perspective view illustrating a ball pitching device 20 according to an alternative embodiment of the present invention, and FIG. 8 is a front view illustrating the ball pitching device 20 illustrated in FIG. 7.

Among the descriptions of an alternative embodiment of the present invention, the description of the ball pitching device 10 according to one embodiment of the present invention will be omitted. The structure of the ball pitching device 20 illustrated in FIG. 7 is merely for illustrating the present invention, and the structure of the ball pitching device 20 is susceptible to various modifications.

Referring to FIGS. 7 to 8, the ball pitching device 20 according to an alternative embodiment of the present invention includes a body portion 100, a ball discharge tube 210 and a ball insert tube 220 on the body portion 100, a pitching unit 300 rotatably disposed between the ball discharge tube 210 and the ball insert tube 220, and a driving unit 700 connected to the pitching unit 300.

The body portion 100 may include a lower frame 110 and an upper frame 130.

The pitching unit 300 is disposed on the body portion 100. The ball discharge tube 210 is connected to one end portion of the pitching unit 300 and the ball insert tube 220 is connected to another end portion of the pitching unit 300. However, the pitching unit 300 is rotatably connected thereto about the center of a ball pitching direction. For example, the pitching unit 300 is connected to the ball discharge tube 210 and the ball insert tube 220 by bearings.

The pitching unit 300 includes a fixing unit 350, a pair of wheel motors 330 at the fixing unit 350, and a pair of pitching wheels 310 connected to the pair of wheel motors 330.

The fixing unit 350 includes a first fixing portion 351 and a second fixing portion 352.

The driving unit 700 includes a driving motor 710, a main driving sprocket 720, a guide sprocket 730, and a chain 740. The driving motor 710 according to an alternative embodiment of the present invention is disposed on the fixing unit 350. For example, the driving motor 710 is disposed on an end portion of the fixing unit 350 on the side of the ball discharge tube 210.

In another alternative embodiment, however, the driving motor 710 may be disposed on an end portion of the fixing unit 350 on the side of the ball insert tube 220. In such an embodiment, the guide sprocket 730 may be disposed on an outer circumferential surface of the ball insert tube 220.

In one embodiment, the driving motor 710 may be protected by a motor case. The motor case is provided around the driving motor 710 to block the noise generated in the driving unit 700.

The main driving sprocket 720 is connected to the driving motor 710. Accordingly, the main driving sprocket 720 receives a rotational force from the driving motor 710 to rotate.

The main driving sprocket 720 is engaged with the chain 740, to be described below, to rotate. Since the guide sprocket 730 is fixed, the main driving sprocket 720 revolves about a center point of the guide sprocket 730. In such an embodiment, as the driving motor 710 is fixed to the fixing unit 750, the fixing unit 750 also rotates as the main driving sprocket 720 revolves.

The guide sprocket 730 is disposed along an outer circumferential surface of the ball discharge tube 210 and fixed thereto. Teeth of the guide sprocket 730 are engaged with teeth of the chain 740. The guide sprocket 730 according to an alternative embodiment of the present invention does not rotate but serves as a guide for revolving of the main driving sprocket 720. That is, the outer circumferential surface of the guide sprocket 730 may correspond to a locus of the main driving sprocket 720.

The chain 740 is engaged with the main driving sprocket 720 and the guide sprocket 730, surrounding outer circumferential surfaces of the main driving sprocket 720 and the guide sprocket 730. Since engaged with the main driving sprocket 720 and the guide sprocket 730, the chain 740 moves in a same direction as a direction in which the main driving sprocket 720 rotates.

The configurations of the ball pitching devices 10 and 20 of the present invention have been described hereinabove.

Hereinafter, an operation of the ball pitching device 10 according to one embodiment of the present invention will be described.

Figure 9:
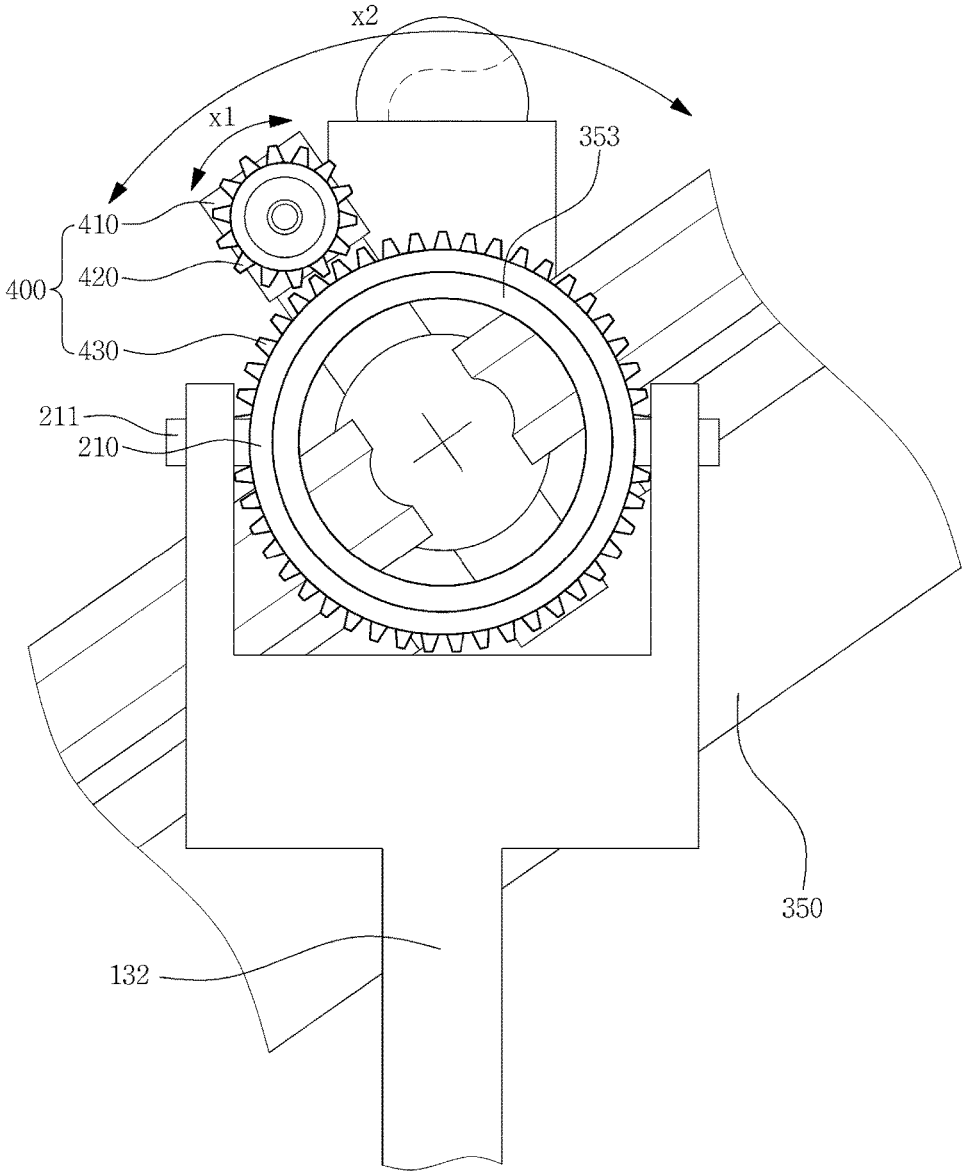
FIG. 9 is a front view illustrating an operation of a driving unit illustrated in FIG. 1.

FIG. 9 is a front view illustrating the operation of the driving unit 400 illustrated in FIG. 1.

Referring to FIG. 9, rotation of the pitching unit 300 according to one embodiment of the present invention starts from the driving motor 410. The driving motor 410 on the pitching unit 300 rotates. The driving motor 410 transmits power to the main driving gear 420 connected thereto. The main driving gear 420 receives the power to rotate. The main driving gear 420 rotates along the guide gear 430 disposed on the outer circumferential surface of the ball discharge tube 210. The guide gear 430 according to one embodiment of the present invention corresponds to the locus of the main driving gear 420. That is, the main driving gear 420 revolves in a clockwise or counterclockwise direction x1 about the center of the ball discharge tube 210.

As the main driving gear 420 revolves, the pitching unit 300 connected to the driving unit 400 rotates in a same direction x2. For example, when the main driving gear 420 revolves in the clockwise direction with respect to the front, the pitching unit 300 rotates in the clockwise direction. Further, when the main driving gear 420 revolves in the counterclockwise direction, the pitching unit 300 rotates in the counterclockwise direction.

By varying the rotational speed and torque of the driving motor 410 to rotate the pitching unit 300, a parabolic curve of the ball pitched from the pitching unit 300 may vary. For example, ball pitches such as a fastball, a slider, a breaking ball, or a changeup may be thrown. Accordingly, the pitches of actual pitchers may be implemented to enhance effectiveness of the batting practice.

Hereinafter, an operation of the upper frame 130 will be described.

Figure 10:
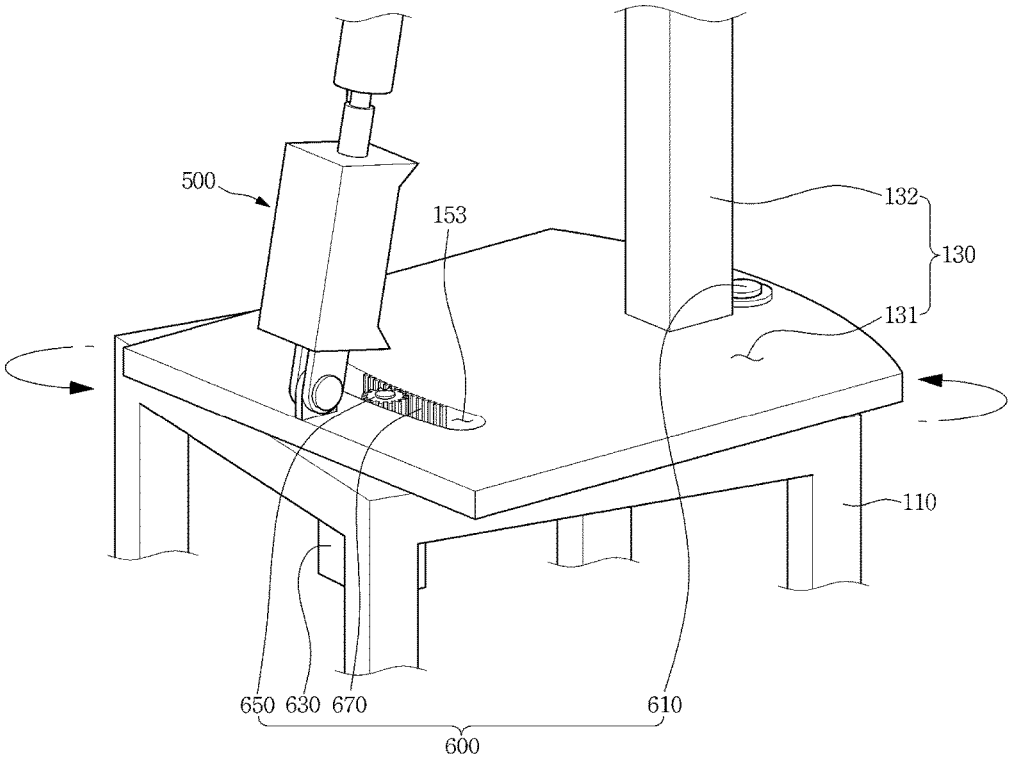
FIG. 10 is a perspective view illustrating an operation of the second pitching angle adjusting unit illustrated in FIG. 1.
Figure 11:
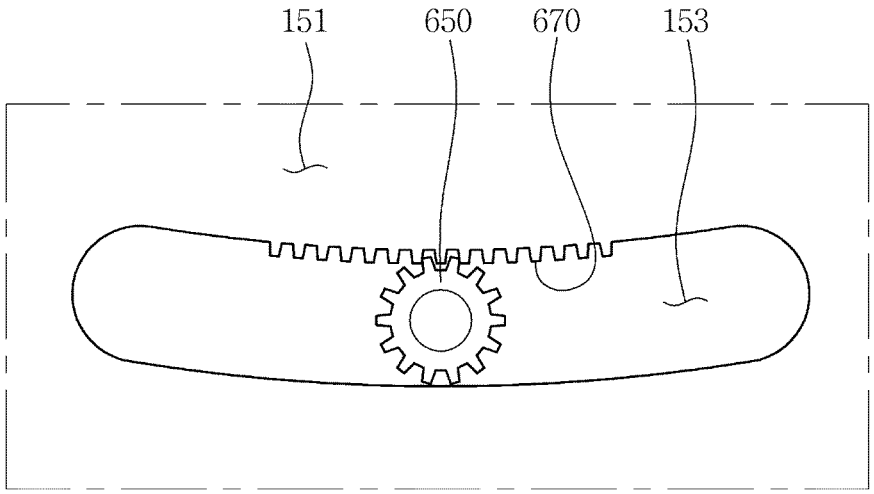
FIG. 11 is a view illustrating a guide groove illustrated in FIG. 10.

FIG. 10 is a perspective view illustrating the second pitching angle adjusting unit 600 illustrated in FIG. 1, and FIG. 11 is a view illustrating a guide groove illustrated in FIG. 10.

Referring to FIGS. 10 and 11, the upper frame 130 on the lower frame 110 rotates about the second rotation shaft portion 610. For example, when a motor which is the second adjusting portion 630 rotates in one direction, the adjusting gear 650 connected to the motor in an axial direction rotates. The adjusting gear 650 is engaged with the driven gear 670 to rotate. Accordingly, the upper frame 130 rotates on a horizontal plane about the second rotation shaft portion 610 in accordance with a rotation direction of the adjusting gear 650.

In an alternative embodiment, the second pitching angle adjusting unit 600 may include at least one sprocket (not illustrated) and at least one chain (not illustrated). The sprocket may be connected to the second adjusting portion 630. The chain may connect the sprocket and the upper frame 130. In order to transmit a driving force of the second adjusting portion 630 to the upper frame 130, the sprocket and the chain may include a plurality of sprockets and a plurality of chains between the second adjusting portion 630 and the upper frame 130.

In addition, the second pitching angle adjusting unit 600 may include at least one pulley (not illustrated) and at least one belt. The pulley may be connected to the second adjusting portion 630. The belt may connect the pulley and the upper frame 130.

Similarly, the pulley and the belt may include a plurality of pulleys and a plurality of belts between the second adjusting portion 630 and the upper frame 130 (refer to 10-2015-0188466 and [0085]).

As set forth hereinabove, in one or more embodiments of the present invention, a ball pitching device includes: a body portion; a ball insert tube, on the body portion, for inserting a ball; a ball discharge tube, on the body portion, for discharging the ball; a pitching unit rotatably coupled to at least one of the ball insert tube and the ball discharge tube to discharge the ball inserted in the ball insert tube to the ball discharge tube; and a driving unit rotating the pitching unit. The pitching unit has substantially a same rotation axis as a central axis of the ball discharge tube.

Accordingly, balls of various pitches may be pitched.

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are not intended to be limiting of the true scope and spirit of the present teachings. Various features of the above described and other embodiments can be mixed and matched in any manner, to produce further embodiments consistent with the invention.

What is claimed is:

1. A ball pitching device comprising:

a body portion comprising an upper frame and a lower frame;

a first rotation shaft portion supported by the upper frame;

a pitching unit configured to pitch a ball and rotate about the first rotation shaft portion and comprising a first pitching wheel and a second pitching wheel;

a first pitching angle adjusting unit adjusting a vertical pitching angle by adjusting a relative length between a bottom surface of the upper frame and the pitching unit; and a second rotation shaft portion connecting the upper frame to the lower frame to be rotatable on a horizontal plane, wherein the first rotation shaft portion is disposed between a center of the first pitching wheel and a center of the second pitching wheel.

2. The ball pitching device as claimed in claim 1, wherein the first pitching angle adjusting unit comprises:

a first adjusting portion;

a length adjusting portion connected to the first adjusting portion; and a housing covering the length adjusting portion.

3. The ball pitching device as claimed in claim 2, wherein the length adjusting portion comprises:

a rotation spindle connected to the first adjusting portion and having threads; and a nut portion fixed to the housing, wherein the rotation spindle is inserted to the nut portion.

4. The ball pitching device as claimed in claim 3, wherein each of the rotation spindle and the nut portion comprises:

a coupling portion spaced apart from the first adjusting portion and having threads; and a non-coupling portion at opposite end portions of the coupling portion.

5. The ball pitching device as claimed in claim 4, wherein an outer diameter of the non-coupling portion of the rotation spindle is less than an inner diameter of the coupling portion of the nut portion.

6. The ball pitching device as claimed in claim 4, wherein an outer diameter of the coupling portion of the rotation spindle is less than an inner diameter of the non-coupling portion of the nut portion.

7. The ball pitching device as claimed in claim 1, further comprising a second pitching angle adjusting unit at the body portion, the second pitching angle adjusting unit adjusting a left and right pitching angle of the pitching unit by rotating the upper frame about the second rotation shaft portion.

8. The ball pitching device as claimed in claim 7, wherein the second pitching angle adjusting unit comprises:

a main driving gear connected to one of the upper frame and the lower frame; and a driven gear connected to the other of the upper frame and the lower frame and engaged with the main driving gear.

9. The ball pitching device as claimed in claim 1, wherein one end portion of the first pitching angle adjusting unit is connected to the body portion by a hinge.

10. The ball pitching device as claimed in claim 9, wherein another end portion of the first pitching angle adjusting unit is connected by a hinge to a ball insert tube configured to insert a ball into the pitching unit.

11. The ball pitching device as claimed in claim 1, further comprising:

a ball insert tube configured to insert a ball into the pitching unit; and a ball discharge tube through which the ball is discharged from the pitching unit, wherein the pitching unit is rotatably coupled to at least one of the ball insert tube and the ball discharge tube and rotates about substantially a same rotation axis as a central axis of the ball discharge tube.

12. The ball pitching device as claimed in claim 11, wherein the pitching unit comprises:

a fixing unit connected to the ball insert tube and the ball discharge tube;

a pair of wheel motors on the fixing unit; and a pair of pitching wheels connected to the wheel motors, respectively.

13. The ball pitching device as claimed in claim 12, wherein the fixing unit comprises:

a first fixing portion substantially parallel to the central axis; and a second fixing portion connected to the first fixing portion and supporting the pair of wheel motors, wherein the first fixing portion comprises a coupling portion rotatably coupled to the ball insert tube and the ball discharge tube.

14. The ball pitching device as claimed in claim 13, further comprising a driving unit rotating the pitching unit, wherein the driving unit comprises:

a driving motor on the fixing unit, the driving motor providing a rotational force;

a main driving gear connected to the driving motor; and a guide gear on an outer circumferential surface of at least one of the ball insert tube and the ball discharge tube, the guide gear engaged with the main driving gear.

15. The ball pitching device as claimed in claim 12, further comprising a driving unit rotating the pitching unit, wherein the driving unit comprises:

a driving motor on the fixing unit, the driving motor providing a rotational force;

a main driving sprocket connected to the driving motor;

a chain engaged with the main driving sprocket; and a guide sprocket disposed along an outer circumferential surface of the ball discharge tube and engaged with the main driving sprocket by the chain.

* * * * *